US006017085A

United States Patent [19]

LaCroix et al.

[11] Patent Number: 6,017,085

[45] Date of Patent: Jan. 25, 2000

[54] FOLDING CHAIR TRAY

[76] Inventors: Tamara D. LaCroix, 220 38th St., Manhattan Beach, Calif. 90266; Kathleen I. Wilber, 1496 North Hill Ave., Pasadena, Calif. 91464

[21] Appl. No.: 08/950,027

[22] Filed: Oct. 14, 1997

[51] Int. Cl.[7] ..... A47B 39/00

[52] U.S. Cl. ..... 297/173; 297/188.15; 297/188.18; 16/343

[58] Field of Search ..... 16/50, 387, 343; 297/188.14, 188.15, 188.18, 173, 175, 170, 162, 161, 188.2, 188.01, 16.1; 248/643, 229.15, 229.25, 230.6, 231.71; 403/398, 396

[56] References Cited

U.S. PATENT DOCUMENTS

| | | | |
|---|---|---|---|
| 646,835 | 4/1900 | Jackson | 297/170 X |
| 854,298 | 5/1907 | Matthews | 297/161 |
| 1,556,622 | 10/1925 | Meharey | 297/170 |
| 2,248,170 | 7/1941 | Hansen . | |
| 2,710,051 | 6/1955 | Greenberg | 297/170 X |
| 3,506,302 | 4/1970 | House . | |
| 3,894,496 | 7/1975 | Phillips et al. | 297/135 X |
| 4,606,576 | 8/1986 | Jones . | |
| 5,139,309 | 8/1992 | Kornreich | 297/162 |
| 5,454,581 | 10/1995 | Ringer | 297/162 X |
| 5,490,710 | 2/1996 | Dearing et al. | 297/162 |
| 5,816,649 | 10/1998 | Shields | 297/162 |

*Primary Examiner*—Milton Nelson, Jr.

[57] ABSTRACT

A removable and pivotal tray which has a tray (22) for holding items on a top surface. A channel (46) with a pair of thumb screws (48) hold the tray to the arm of a portable folding chair and a hinge (54) is attached to the tray and channel. The hinge permits the tray to pivot 270 degrees from horizontal during use and then be lowered downward to the side of the chair when not in use. The tray swivels a full 360 degrees when horizontal to provide the most convenient location for the user. The pivoting is provided by the use of flanged bushing (68) disposed within a counterbore (70) in the channel, and a pair of resilient washers (72), provide controlled resistance to maintain the trays position. The tray may be flat or include upstanding flanges (32) and alternatively a lid (34) or spring clip (28). A kickstand (82) may be optionally utilized to tilt the tray angularly for reading or writing. A second embodiment omits the channel and thumb screws and incorporates a flange bushing directly into a chair arm (80) for a non-removable integral tray.

3 Claims, 5 Drawing Sheets

FOLDING CHAIR TRAY

TECHNICAL FIELD

The present invention pertains in general to trays that attach to folding chairs and, more particularly, to a removable and pivotal tray that attaches to a portable beach chair.

BACKGROUND ART

Some of the most common problems of holding and/or storing food and beverages while eating and drinking occur while a person is at a location where the surrounding ground is not completely level, such as a park, or where there is dirt or sand, such as a beach. At these locations the food or beverage can either tip over and spill, or become contaminated by the dirt and sand. The only way for a person to avoid the problems of food or beverages tipping over or becoming contaminated with dirt or sand is to completely finish eating or drinking the item after opening, or by putting the item into a container, such as an ice cooler. Neither of these options is particularly convenient. Many people prefer to slowly eat or drink and sometimes even take short breaks, to allow maximum enjoyment of their food and drink. While an ice cooler does provide safe keeping, it often becomes inconvenient to continually have to remove and replace a food or drink item.

There are prior art trays that have been designed to provide a method of holding and storing food and beverages on folding portable chairs such as lawn chairs and chaise lounges. These trays are limited to fixed trays that attach to both the arms or to trays that include brackets that attach to other structural members of a chair. Some prior art chairs swivel to position the tray horizontally when attached to a single arm and others drop the tray to the side of the chair for storage. Unfortunately, none of these chairs have been designed around a beach-type chair design, which provides a specialized type of seating for the unique topography of a beach. This presents a problem because a beach, or similar environment, is exactly where a chair with a built-in tray would be most effective.

A search of the prior art did not disclose any patents that read directly on the claims of the instant invention however, the following U.S. patents were considered related:

| U.S. PAT. NO. | INVENTOR | ISSUED |
|---|---|---|
| 5,425,455 | Miller, et al | 20 June 1995 |
| 5,038,451 | Smith | 13 August 1991 |
| 4,807,928 | Cone | 28 February 1989 |
| 4,662,676 | Havelock | 5 May 1987 |
| 4,575,149 | Forestal, et al | 11 March 1986 |
| 4,548,440 | Meslin, et al | 22 October 1985 |
| 4,405,046 | Schultz, et al | 20 Sept. 1983 |
| 4,300,798 | Musgrove, et al | 17 November 1981 |
| 4,003,598 | Glaze | 18 January 1977 |
| Des. 324,791 | Hoover | 24 March 1992 |
| Des. 268,072 | Boggs | 1 March 1983 |

Smith in U.S. Pat. No. 5,038,451 teaches a tray which attaches to both arms of a folding lawn chair.

The tray is removable with button knobs on the bottom of the arms for access to the chair. The chair is stored in the folded position with the tray in place.

U.S. Pat. No. 4,662,676 of Havelock is for an arm tray attached to one arm of a chair by an adjustable hook and pile fastener that wraps around the chair arm. A brace, of adjustable length, is attached to a swivel on an underside of the tray, and recessed depressions are in the tray for storing eating utensils.

Forestal, et al U.S. Pat. No. 4,575,149 discloses a household service tray attached to a furniture arm with a support having parallel legs that adjustably straddle the furniture article, such as an overstuffed chair. The tray rotates to provide an over-the-seat position and the tray drops downward outside the arm when not in use.

U.S. Pat. No. 4,300,798 issued to Musgrove, et al teaches a folding chair that includes a collapsible tray mounted on one leg using a separate mounting bracket. An L-shaped arm allows elevation and angular adjustment to be made, and permits the tray to be rotated vertically for storage.

Glaze's U.S. Pat. No. 4,003,598 is for a tray attached to or integrally formed with a chair arm. A track on the arm permits the tray to be swung about a vertical axis and then be moved lengthwise along the track for convenient positioning relative to a person sitting in the chair.

For background purposes and as indicative of the art to which the invention relates, reference may be made to the patents issued to Miller et al, Cone, Meslin et al, Schultz et al, and the design patents of both Hoover and Boggs.

DISCLOSURE OF THE INVENTION

In the past there has been a need to provide a tray for storing and holding food items, on portable chairs such as beach chairs, lawn chairs and chaise lounges. These chairs are not usually heavy and often utilize a web of synthetic strap material that is woven over a tubular aluminum frame. A common problem for a person who is trying to enjoy food and beverages while at a location such as a beach or a park is the difficulty in attempting to balance food without a tray or other level surface of some type. Usually, no convenient location exists, except the person's lap, which requires balance and little or no movement. Further, if a tray is attached to a chair it must be capable of being positioned out of the way for the person to sit down while not being so heavy that it will tip a lightweight chair.

It is therefore a primary object of the invention to provide a removable tray for a portable chair that is attached to either one of the arms and is capable of swiveling or rotating a full 360 degrees for complete access and convenience of use. The present invention also pivots upward from a horizontal position to a downward hanging position for storage. The rotational capabilities allow a person to easily sit unobstructed on the chair while also permitting the tray to rotate horizontally to the most optimum position during use.

It may be clearly seen that the combined utility of removability, rotatability, reversability and storage are of prime importance and fill the need for this type of tray and distinguish it over prior art.

An important object of the invention is the ability of the tray to be installed and removed from a chair with ease. A pair of thumb screws are all that is required for installation of the tray, which is easily accomplished and intuitively obvious in its function and application. Further, the device may be easily installed and removed any number of times without marring or causing permanent deformation of the chair. Usually lightweight chairs have relatively thin extruded aluminum arms or slim wooden arms. When thumb screws, which have C-clamp swivels on the threaded end, are rotated in compression on the arm, the broad surface of the clamp and extended area of the swivels distribute the force evenly and leave no marks or damage to the arm.

Another object of the invention is the tray's versatility. Since the pivot, swivel and attachment means are extremely simple and require attachment of the tray to only a flat surface, any variety of tray may be used. A flat tray, clipboard tray, flanged tray with a raised lip, enclosed tray with a lid, or other variations may be used with equal results and ease. The addition of an optional beverage container hole or depression also improves the tray's function. The tray is attached with conventional hardware, such as rivets, and/or bolts, and one embodiment includes a friction fit between the tray and the hinge.

Still another object of the invention is the tray's simplicity, as it only utilizes four basic elements: a tray, a clamp, a hinge and a swivel joint, with each comprised of easily manufactured components. The tray may be made of a myriad of materials, which may be stamped, formed or molded into the desired shape. The clamp may be extruded or stamped, pierced and formed of aluminum, and the hardware is standard in the industry. The hinge requires only minimal modification from typical hinge components and the swivel joint utilizes common hardware and a simple manufactured bushing. All of the components required for the tray are lightweight and corrosion resistant for use in environments such as the beach, where air with salt spray is prevalent.

Yet another object of the invention is directed to its cost effectiveness. Only simple tooling is required to manufacture the tray and the mortise hinge, which is the main functioning component, may be purchased inexpensively. The simple design and use of standard hardware, along with the above-mentioned machining and tooling processes, lead to a product that can be constructed and sold at a reasonable price.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred and a second embodiment which utilizes a tray 22 that is presented in several design configurations. The preferred embodiment, as shown in FIGS. 1 through 27, utilizes an attachment means that controls the position of the tray 22 which has a flat top surface for holding food, beverages and the like when a person is sitting in a portable folding chair 24. The preferred embodiment also includes a kickstand for supporting the tray in a tilted position.

It should be noted that the drawings illustrate a beach chair, however any type of folding chair may be used with the invention, such as a lawn chair, chaise lounge or any other furniture having horizontal flat arms. The invention provides utility for persons using these chairs and is not limited for only holding food, as many other items are normally stored by people using this type of chair such as reading material, clothing, eyeglasses, sunscreen and other articles.

The tray 22, with its flat surface, is ideal for holding or storing items, as described above, however, the invention includes a number of different configurations of the tray as it is not limited to a single embodiment.

Figure 9:
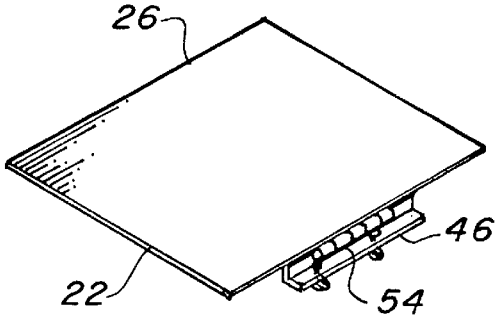
FIG. 9 is a partial isometric view of the tray in the flat embodiment completely removed for clarity.
Figure 10:
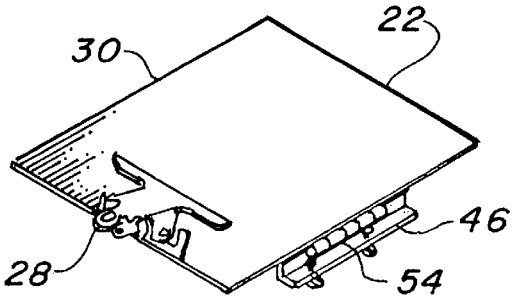
FIG. 10 is a partial isometric view of the tray in the clipboard embodiment shown completely removed for clarity.

FIG. 9 illustrates the basic flat tray 26 with a rigid substrate having a smooth, flat surface. FIG. 10 depicts the same surface with a spring clip 28 fastened near the outermost edge creating a clipboard tray 30.

Figure 11:
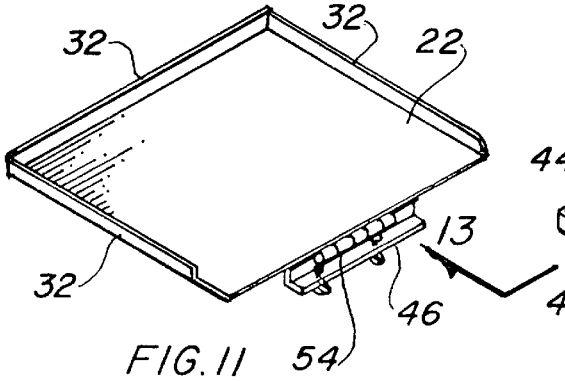
FIG. 11 is a partial isometric view of the tray in the upstanding flange embodiment shown completely removed for clarity.

The preferred embodiment is shown in FIG. 11 and employs the flat surface but adds an upstanding flange 32 on at least three edges for protection of the tray's contents in the event the chair is tipped, bumped or otherwise physically disturbed. It has been found that a flange 32 of 0.50 inch (1.27 cm) in height is ideal, however other heights may also be used with equal results.

Figure 14:
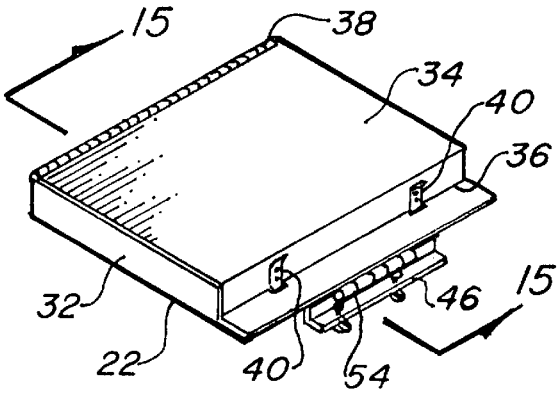
FIG. 14 is a partial isometric view of the tray with a hinged lid.
Figure 15:
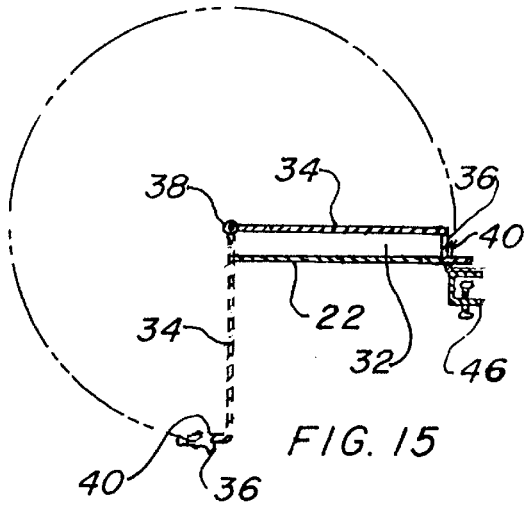
FIG. 15 is a cross-sectional view taken along lines 15—15 of FIG. 14 depicting the lid opened in dash lines.
Figure 16:
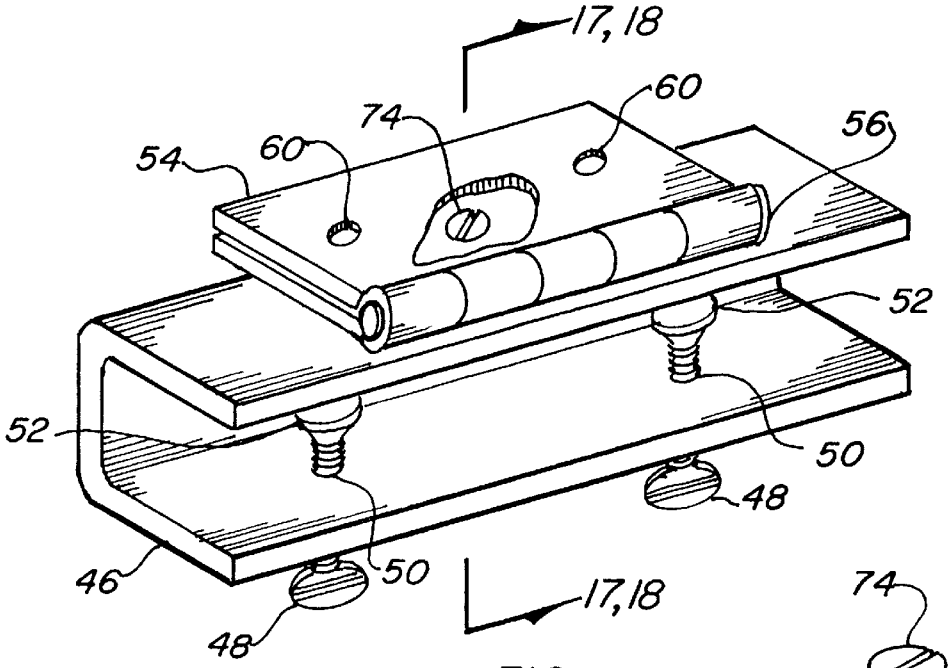
FIG. 16 is a partial isometric view of the C-shaped channel and hinge assembly completely removed for clarity
Figure 19:
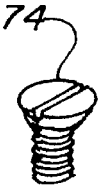
FIG. 19 is a partial isometric view of the flat head screw of the swivel means completely removed for clarity.

FIGS. 14 and 15 illustrate the same flange 32 on three sides but with the addition of a lid 34 with a downward extending lip 36. A continuous hinge 38 and fastener 40 enclose the tray to create a container.

Figure 12:
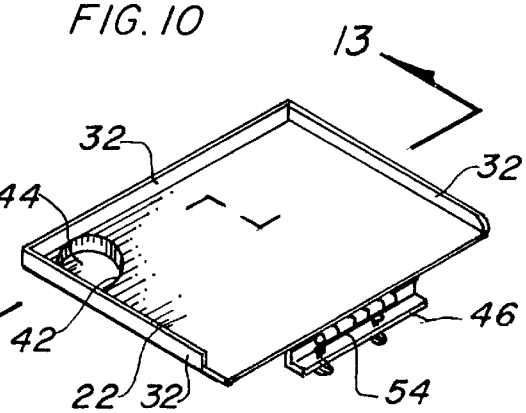
FIG. 12 is a partial isometric view of the tray in the upstanding flange with beverage hole shown completely removed for clarity.
Figure 13:
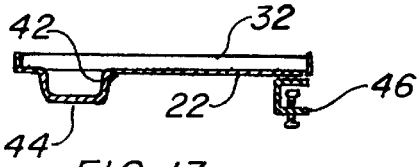
FIG. 13 is a cross-sectional view taken along lines 13—13 of FIG. 12 depicting the beverage hole with a bottom member.

FIG. 15 indicates the lid's rotational travel with dashed lines, permitting the lid 34 to be opened and subsequently lowered out of the way. The lid fasteners 40 may be of any type known in the art, such as the spring clips that are illustrated, quarter turn fasteners, latches, snap fasteners, or hook and loop tape. A beverage containing hole 42 that is depicted in FIG. 12 may be added to the tray. The hole 42 may have a diameter greater than a beverage container bottom but no less than its top diameter to permit the cup to be wedged in the hole. Preferably the hole 42 includes a bottom 44 for a beverage which comes in a container that is not tapered, such as a soft drink can, or the invention may contain both features. FIG. 13, in cross section, shows the bottom 44 as an integral part of the tray 22 however, a separate structure may be attached to the underside of the tray with equal ease.

The tray 22 may be any appropriate size relative to the chair upon which it is attached. It has been found however that a rectangular shape 10–12 inches (25.4–30.5 cm) by 12–14 inches (30.5–35.6 cm) is within the range of most commonly manufactured beach chairs. The material for the tray 22 again may be any substance suitable for the application, including light weight metal, such as aluminum, thermoplastic, composition board, wood, fiberglass and the like. The flange 33 and beverage container bottom 44 may be formed, glued, riveted or molded integrally with the tray.

Attachment means in the form of a C-shaped structural channel 46 containing a plurality of thumb screws 48, shown in FIGS. 5–8 and 16–18, hold the tray 22 to the arm of a chair 24. Two thumb screws 48 are preferred and are positioned within threaded holes 50 in the channel 46. Each screw 48 may contain a O-clamp swivel 52, if desired, as its flat surface tends to distribute compressive force over an extensive area between the screw 48 and the underside of the arm of the portable folding chair 24. The channel 46 may be fabricated of aluminum, or other similar material, and is either extruded into the channel shape or sheared, punched and threaded in the flat and then bent into the channel shape with a power brake. The compressible retention of the channel 46 to the chair 24 permits easy installation and removal by rotating the pair of thumb screws 48.

Pivot means in the form of a mortise hinge 54 with a fixed pin 56 permit the tray 22 to pivot from a horizontal position during use to a vertical position for storage that is contiguous with the portable chair 24 when it is folded. This hinge 54 is illustrated best in FIG. 16 and shown in end-view in FIGS. 5–8, 17 and 18. A mortise hinge 54 is preferably utilized as the leaves are substantially contiguous when folded shut. A countersunk hole 58 is located in one leaf of the hinge in an essentially centered position, as shown through the cut-away in FIG. 16. Attaching holes 60 are punched in the opposing leaf for joining the tray 22 to the hinge 54 with rivets, threaded fasteners or similar means. While a mortise hinge is preferred, other types and styles may be used such as a thermoplastic living hinge, continuous hinge or the like.

Figure 8:
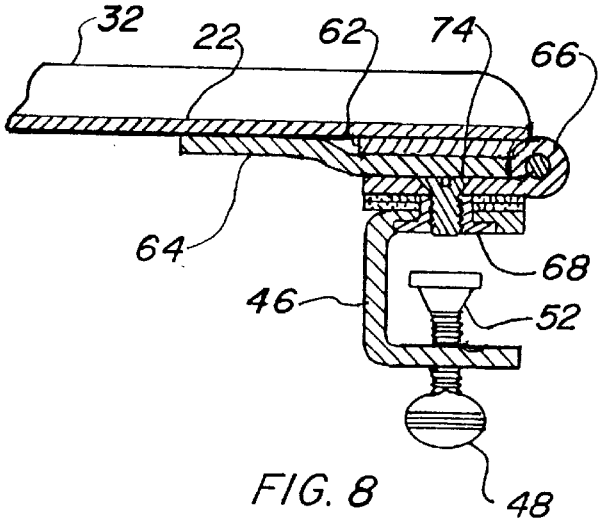
FIG. 8 is a is a cross-sectional view taken along lines 8—8 of FIG. 2 showing the tray swiveled outward in the hinge receiving pocket configuration.

In an embodiment illustrated in FIG. 8 a pocket 62 is added to the underside of the tray 22 to receive the hinge in a removable manner, such as a slip fit. An offset plate 64 is attached to the tray 22 by bonding, spot welding, riveting or other methods to form the pocket 62, or it is molded integral with the tray. The hinge in this embodiment is therefore a surface hinge 66, which has a gap between the leaves which allows sufficient room to receive the bottom portion of the pocket 62 or specifically the offset plate 64. A further convenience of the invention is that the tray 22 may be easily removed for cleaning or storage.

Swivel means integral with the pivot means and attaching means permit the tray 22 to rotate or swivel horizontally, thus providing complete access to the chair 24 without disturbing items stored on the tray. This action also permits the tray to be relocated to a more convenient position when a person is seated in the chair. The swivel means is presented in two embodiments having only minor variations.

Figure 17:
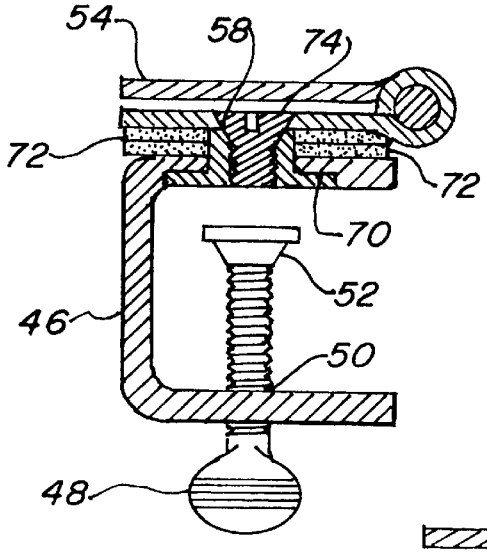
FIG. 17 is a cross-sectional view taken along lines 17—17 of FIG. 16 illustrating the preferred swivel means.
Figure 20:
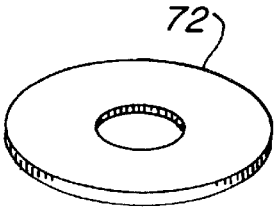
FIG. 20 is a partial isometric view of the first resilient washer of the swivel means completely removed for clarity.
Figure 21:
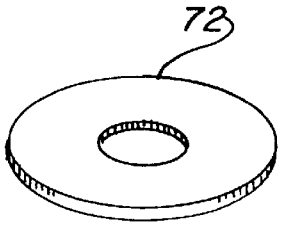
FIG. 21 is a partial isometric view of the second resilient washer of the swivel means completely removed for clarity.
Figure 22:
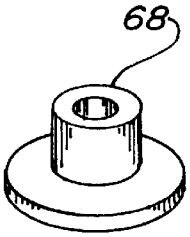
FIG. 22 is a partial isometric view of the flanged bushing of the swivel means shown completely removed for clarity.
Figure 23:
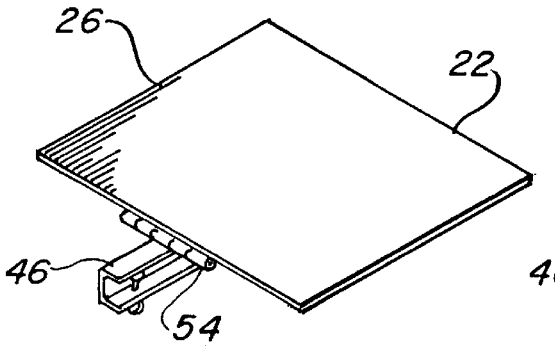
FIG. 23 is a partial isometric view of the kickstand variation of the preferred embodiment with the flat tray removed from the chair for clarity.
Figure 24:
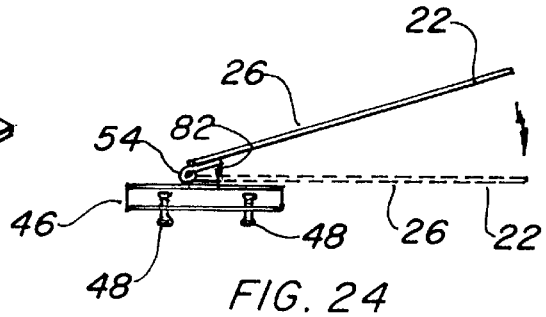
FIG. 24 is a right side view of the same embodiment as FIG. 23.

The preferred embodiment of the swivel utilizes an internally threaded flanged bushing 68, as shown in FIG. 17 and 22. This bushing 68 may be made of any material such as brass, steel, sintered bronze or a similar material, with brass being preferred. A counterbore 70 is cut into the underside of the upper leg of the channel 46 to receive the flange of the bushing 68, as depicted in FIG. 17. When the bushing 66 is inserted into the counterbore 70, a small portion protrudes above the upper leg of the channel 46 and a pair of resilient washers 72, depicted in FIGS. 20 and 21 are positioned thereupon. The washers 72 are contiguous with both the channel 46 and the hinge 54, as illustrated in the cross section of FIG. 17.

A flat head screw 74 is inserted into the countersunk hole 58 in the hinge 54 and tightened into the threaded flanged-bushing 68, thereby drawing the bushing into intimate contact with the hinge. This arrangement compresses the washers 72 to a controlled thickness, which provides a constant and even force upon the interface, thus permitting the hinge 54 to swivel only when manually forced in the desired direction. The resistance to movement is governed and maintained by the amount of compression on the washers 72 dependent upon the height of the portion of the bushing 68 that protrudes above the channel 46. When certain materials are used in construction of the washers 72 it has been found that placing an adhesive between each washer and the appropriate hinge 54 or channel 46 is advantageous. The adhesive will assure that the washer remains attached to the outer surface, to permit the contiguous surfaces to rotate together. The material for the washers 72 may be any resilient substance such as a latex synthetic rubber, thermoplastic or the like, with a latex being preferred.

The screw 74 is connected to the bushing 68 with joining means to assure that the bushing revolves within the counterbore 70 when the tray is rotated. This joining means preferably consists of brazing the joint together with a brazing alloy heated to a liquidous state and drawn by capillary action into the interface of the countersunk hole 58 and on inward-tapered flat head screw 74. Other methods may be used such as lead/tin solder or application of an anaerobic liquid that sets and cures in the absence of air.

Figure 18:
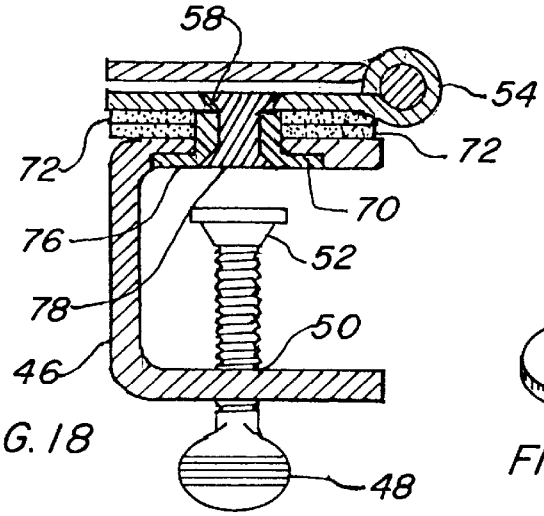
FIG. 18 is a cross-sectional view taken along lines 18—18 of FIG. 16 illustrating the swivel means riveted configuration.

The second variation of the swivel means is illustrated in FIG. 18 and differs in that the bushing 68 is replaced by a flanged-bushing having a countersunk bore 76 instead of the bushing containing internal threads.

The screw 74 is replaced with a flat head rivet 78, which is disposed within the countersunk bore in the bushing 76 and bucked into the countersunk hole 58 in the hinge 54, thereby compressing the washers 72 together. The remaining elements of the swivel means stays the same, including the joining means of the preferred embodiment.

Figure 25:
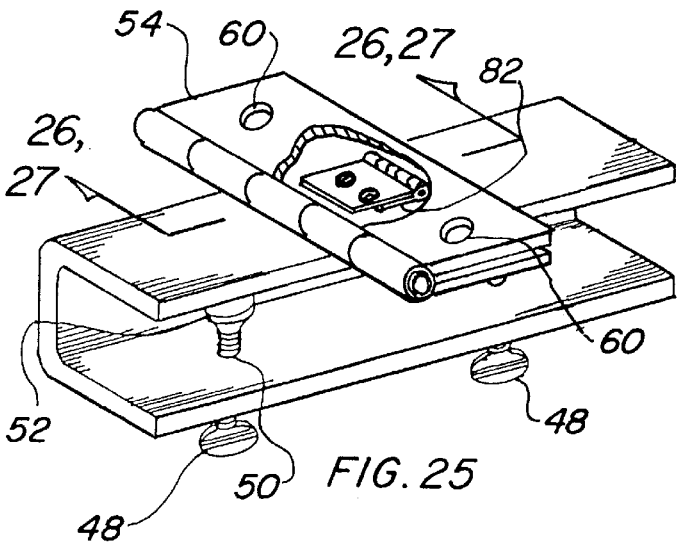
FIG. 25 is a partial isometric view of the kickstand variation of the C-shaped channel and hinge assembly completely removed from the invention for clarity and cut away to illustrate the location of the kickstand.
Figure 26:
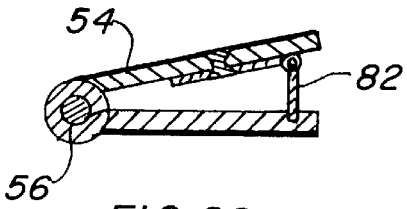
FIG. 26 is a cross sectional view taken along lines 26—26 of FIG. 25 with the kickstand down.
Figure 27:
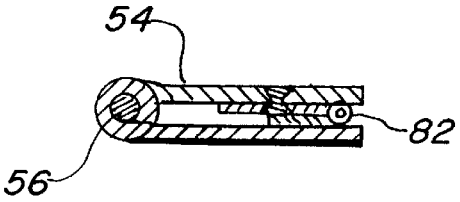
FIG. 27 is a cross sectional view taken along lines 27—27 of FIG. 25 with the kickstand folded flat.

The preferred embodiment also includes the addition of a hinged kickstand 82 as illustrated in FIGS. 23–27. The kickstand 82 consists of a continuous hinge that is attached to an inner upper leaf of the mortise hinge 54 with rivets or the like as depicted in FIG. 25. One leg of the kickstand 82 may be shorter than the other for convenience of attachment or they both may be the same length. Regardless of the length, one leg is free to swing down by gravity when the tray 22 is tilted upward as shown in FIG. 26. This action permits the kickstand 82 to form a buttress support which positions the tray 22 at an upward angle to allow the tray to be used for reading or writing. The kickstand 82 may intersect the lower leaf of the mortise hinge 54 with a groove, depression or a barrier formed by rivet heads, weld heads or any other obstacle to prevent the leaf from slipping. To return the tray 22 to the horizontal position, as illustrated in FIG. 27, the tray user reaches underneath the tray while tilting slightly upward and depresses the kickstand 82 such that it swings upward into a horizontal position.

It is of particular importance that the invention permits rotation of the tray 22 a full 360 degrees, which allows the user to position the tray in any location within the radius of the swivel means. While due to some chairs 24 having short arms, it may be necessary to lift the tray upward slightly to clear the chair back where it interferes in the rotation however, it still retains the capabilities of complete and full rotation.

Figure 1:
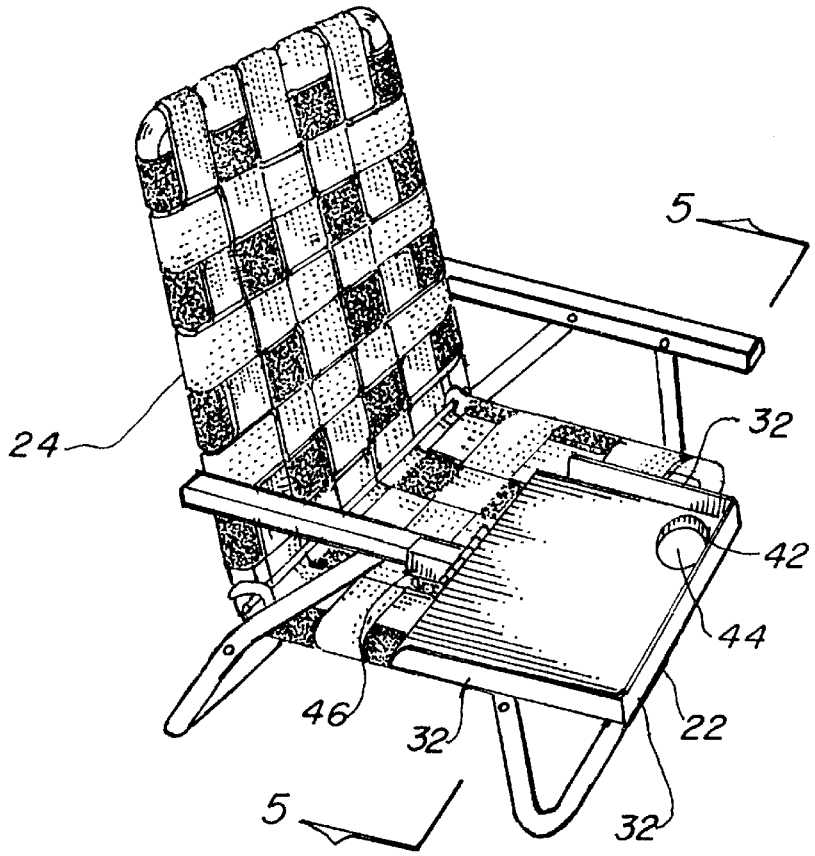
FIG. 1 is a partial isometric view of the preferred embodiment with the tray positioned forward.
Figure 2:
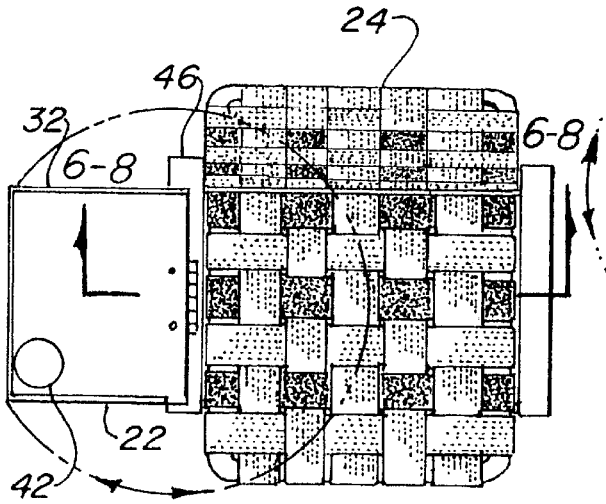
FIG. 2 is a plan view of the preferred embodiment with the tray swiveled outward thereby also illustrating the 360 degree rotation capability of the tray.

When the invention is to be used, the channel 46 is placed over the arm of a chair 24 and the thumb screws 48 are tightened. The lid 22 may be vertical or horizontal over the seat during this attachment. The lid 22 is pivoted until the leaves of the hinge 54 interface and the top surface of the tray is disposed horizontally. The user may then swivel the tray 22 out of the way to permit access to the seat as shown in FIG. 2. The tray is then swiveled to the most convenient position, as depicted in FIG. 1, and selected items may then be placed on the top surface.

Figure 3:
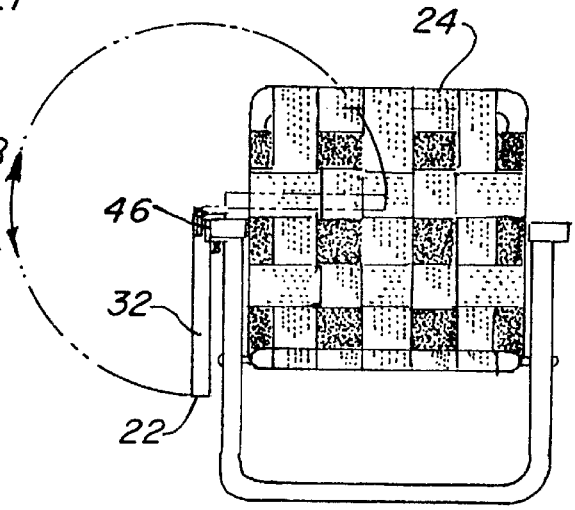
FIG. 3 is a front view of the preferred embodiment illustrating the tray's capabilities of 270 degree pivoting.

If the user wants to leave the chair, the tray and the contents thereupon may be swiveled out of the way. When the tray is no longer required, the user lifts the tray upward and pivots it 180 degrees. It is then swiveled until the inner edge is parallel with the chair arm. It may then be lowered out of the way, as illustrated in FIG. 3.

Figure 4:
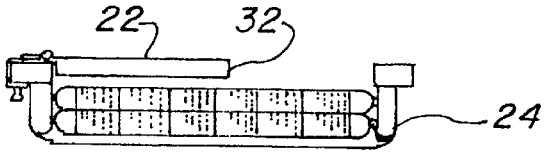
FIG. 4 is a front view of the preferred embodiment in the folded storage position.
Figure 5:
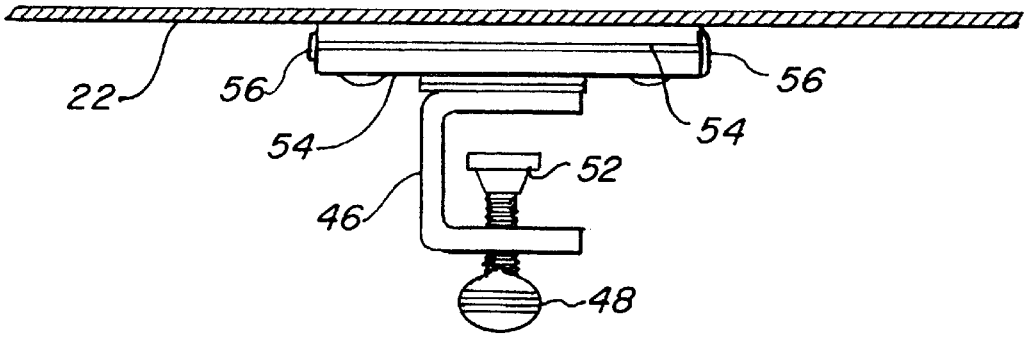
FIG. 5 is a cross-sectional view taken along lines 5—5 of FIG. 1 showing the tray swiveled outward.
Figure 6:
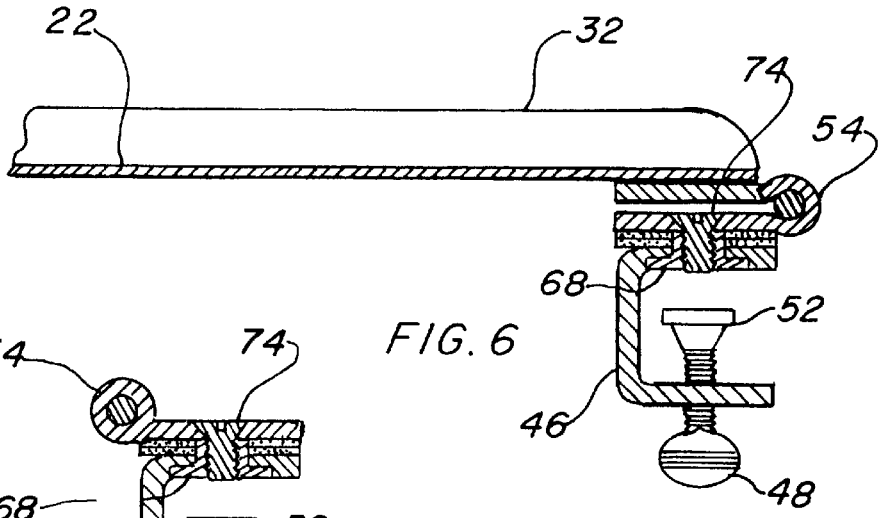
FIG. 6 is a cross-sectional view taken along lines 6—6 of FIG. 2 with the tray swiveled to the side of the chair.
Figure 7:
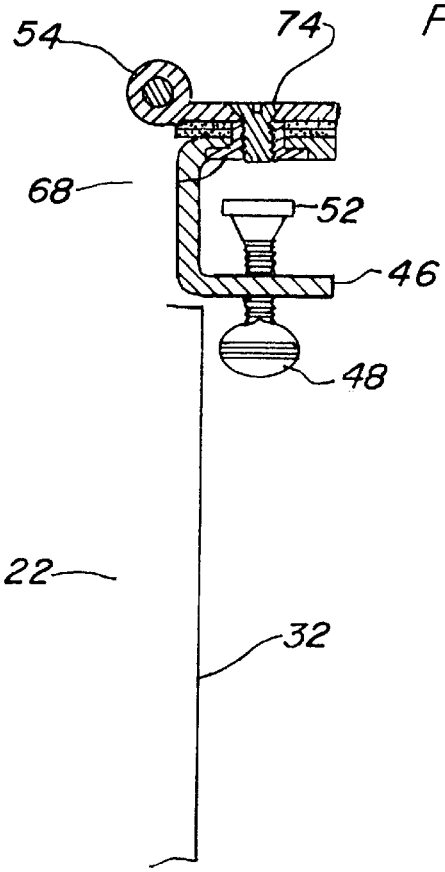
FIG. 7 is a cross-sectional view taken along lines 7—7 of FIG. 2 with the tray pivoted downward.

The chair may be collapsed and the tray pivoted on top of the chair back, as depicted in FIG. 4. The chair may then be carried in this manner and, if desired, the tray can remain attached to the chair during storage.

Figure 28:
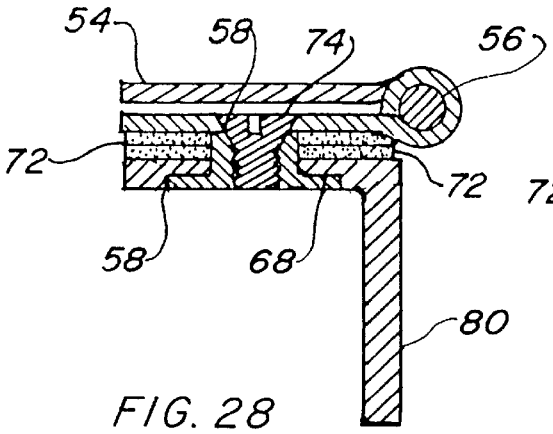
FIG. 28 is a cross sectional view of the second embodiment with the swivel means in the preferred screwed configuration taken along the centerline of the invention.
Figure 29:
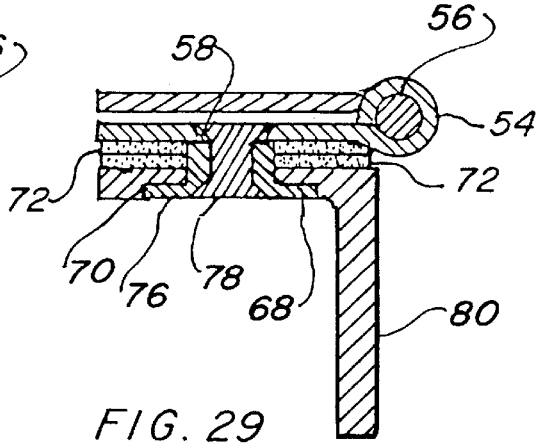
FIG. 29 is a cross sectional view of the second embodiment with the swivel means in the riveted configuration taken along the centerline of the invention.

The second embodiment is illustrated in FIGS. 28 and 29 and functions in the same manner and utilizes the same elements as the preferred embodiment except that channel 46 and thumb screws 48 are replaced by the flat arm 80 of the chair 24. This second embodiment therefore forms a permanent or integral tray that is not removed form the chair. The chair arm 80 contains the counterbore 70 and either the preferred bushing 68 with its screw 74, shown in FIG. 28, or the second variation with its countersunk bore bushing 76 and flat head rivet 78, illustrated in FIG. 29.

While the invention has been described in complete detail and pictorially shown in the accompanying drawings it is not to be limited to such details, since many changes and modifications may be made to the invention without departing from the spirit and scope thereof. For example, the channel 46 and the C-clamp swivel 52 can be illuminated. In this design, the bushing 68,76 is integrally located on the chair arm. Into the bushing 68,76 is threaded a screw 74 or a rivet 78 respectively which attaches the hinge 54 that controls the position of the tray 22. Hence, it is described to cover any and all modifications and forms which may come within the language and scope of the claims.

What is claimed is:

1. A removable and pivotal tray for a portable folding chair comprising:

(a) tray means having a top surface for holding food, beverages and other items, (b) attachment means connected to the tray means for holding the tray means to an arm of the chair in a removable manner, (c) pivot means connected to the tray means and juxta-positioned with the attachment means from a horizontal to a vertical position for storage contiguous with the portable chair when folded, (d) swivel means, integral with the pivot means, for rotating the tray means horizontally in order to have access to the chair without disturbing items stored on the top surface of the tray means and to place the tray means in a convenient position for use, and (e) hinged kickstand means forming a buttress support for angular disposition of the tray means.

2. The pivotal tray as recited in claim 1 wherein said swivel means further comprises a flanged-bushing having a countersunk bore therethrough, with said attachment means having a counterbore to receive said bushing with a portion protruding thereabove, a flat heat rivet means, and a pair of resilient washers positioned over the protruding portion of the bushing contiguous with both the rivet means and the attaching means, said pivot means having a countersunk hole in alignment with said bushing, and said flat head rivet disposed within the bore in the bushing and bucked into the countersunk hole compressing the washers together such that the bushing revolves with the pivot means when the tray is rotated.

3. The pivotal tray as recited in claim 2 wherein said flanged-bushing, washers and flat head rivet permit the tray to rotate a full 360 degrees.

* * * * *